US005694956A

United States Patent [19]

Grinszpan

[11] Patent Number: 5,694,956

[45] Date of Patent: Dec. 9, 1997

[54] HAIR SLIDE ASSEMBLY

[75] Inventor: Monique Elisabeth Mireille Grinszpan, Theophile de Bockstraat 79 I, 1058 VA Amsterdam, Netherlands

[73] Assignees: Monique Elisabeth Mireille Grinszpan, VA Amsterdam; Maxim Michel Grinszpan, TM Amsterdam, both of Netherlands

[21] Appl. No.: 561,994

[22] Filed: Nov. 22, 1995

[30] Foreign Application Priority Data

Dec. 2, 1994 [NL] Netherlands ..... 9402029

[51] Int. Cl.[6] ..... A45D 8/12

[52] U.S. Cl. ..... 132/275; 132/273; 132/276; 132/277; 132/278

[58] Field of Search ..... 132/273, 275, 132/276, 277, 278, 279, 144, 145, 146, 148, 101

[56] References Cited

U.S. PATENT DOCUMENTS

| | | | |
|---|---|---|---|
| 1,532,495 | 4/1925 | Jensen . | |
| 1,983,978 | 12/1934 | Goodman | 132/144 |
| 1,998,699 | 4/1935 | Behr . | |
| 2,262,060 | 11/1941 | Solomon | 132/144 |
| 2,496,487 | 2/1950 | Moses | 132/144 |
| 2,649,763 | 8/1953 | Buergi-Schenk | 132/144 |
| 2,902,042 | 9/1959 | Halber | 132/279 |
| 5,284,167 | 2/1994 | Gill | 132/278 |
| 5,533,533 | 7/1996 | Shing | 132/276 |

FOREIGN PATENT DOCUMENTS

| | | |
|---|---|---|
| 346810 | 2/1905 | France . |
| 385475 | 5/1908 | France . |
| 432005 | 11/1911 | France . |
| 433070 | 12/1911 | France . |
| 111907 | 7/1900 | Germany . |
| 367719 | 1/1923 | Germany . |

*Primary Examiner*—Gene Mancene
*Assistant Examiner*—Pedro Philogene
*Attorney, Agent, or Firm*—Panitch Schwarze Jacobs & Nadel, P.C.

[57] ABSTRACT

The invention relates to a hair slide assembly for holding together and decorating hair. The assembly is provided with a carrier to which is attached a decorative part, which carrier and decorative part within the assembly, when in use, are positioned at an angle to each other. The decorative part is provided with a clasp for holding the hair.

9 Claims, 1 Drawing Sheet

HAIR SLIDE ASSEMBLY

BACKGROUND OF THE INVENTION

The present invention relates to a hair slide assembly for holding together and decorating hair, which assembly is provided with a carrier to which is attached a decorative part, which carrier and decorative part within the assembly, when in use, are positioned at an angle to each other.

Such a hair slide assembly is known from the French patent specification 385.475. Herein a hair comb is described which is provided with a fastening means in the form of a hook onto which the decorative part can be mounted. The disadvantage of this assembly is that the comb by itself fails to keep the hair in style when it is made into, for instance, a pony tail. In addition, the fastening means is clearly visible when the comb is used without the decorative part.

The object of the present invention is to provide a hair slide assembly as mentioned in the preamble, which by simple means keeps the hair, in particular the pony tail, in style while only the decorative part is clearly visible on the head.

BRIEF SUMMARY OF THE INVENTION

To this end the hair slide assembly according to the invention is characterized in that the decorative part is provided with a clasp for holding the hair.

By means of this clasp the hair is held in style properly. As furthermore the decorative part and thus also the clasp is positioned at an angle to the carrier, the hair slide assembly, when fixed on the top of the head will not only clearly exhibit the decorative part, but will also first guide the hair upward and then to the back or to the side, which gives a decorative appearance.

One preferred embodiment is that where the decorative part is mounted substantially perpendicular on the carrier. This embodiment is very suitable for being placed on the top of the head. In this way the decorative part is easily visible and the assembly will go well with matching earrings. It is an advantage if the decorative part and the carrier are detachably fastened to each other. The advantage of this is that, for instance, another decorative part van be attached to the carrier. Moreover, the decorative part can also be used on its own, since it is provided with a clasp for holding the hair together. The user is free to put the assembly together according to his/her own wishes.

It is advantageous if fastening means are applied to the side of the clasp of the decorative part. In this way the fastening means will hardly be visible.

One advantageous embodiment is that in which the decorative part is a hair slide. This hair slide, or hair clip, is already available in many forms and sizes.

It is advantageous if the carrier is a comb. The comb ensures extra hold. Such a comb is also already available.

A simple but effective embodiment is one in which the fastening means take the form of a groove formed on the reverse side of the decorative part of the hair slide to receive at least part of the rim of the comb facing away from the teeth of the comb. This allows the comb in the hair slide assembly according to the invention to remain intact, so that a commercially available comb can be used; it is then only necessary to provide the hair slide with a groove. This groove is in practice hardly visible, seeing as this is at the reverse side of the hair slide. Fastening the hair slide to the comb is easy, requiring no extra parts. For reasons of low production costs it is desirable, however, that the fastening means are formed by an element which is provided with a groove, which element is detachably fastened to the reverse side of the decorative part of the hair slide. In this way no special steps need to be taken for the production of the decorative part or the hair comb.

Another advantageous embodiment is one where the fastening means are an assembly comprising at least a snap fastening element for the reception of a recess formed at one side of the comb and at least two hooks for the reception of projections formed at the side opposite to the comb. This results in a firm but easily detachable fastening between the comb and the hair slide.

The invention further comprises a decorative part which is fitted for use in the hair slide assembly described above, as well as a separate carrier suitable for this purpose.

Finally, exclusive rights are requested for a packing containing a separate carrier, a separate decorative part and a fastening means for assembling the decorative part and the carrier into a hair slide assembly.

BRIEF DESCRIPTION OF THE SEVERAL VIEWS OF THE DRAWINGS

The invention will be elucidated with reference to the schematic drawing showing an embodiment of the hair slide assembly according to the invention.

FIGS. 2, 3 and 4 are cross sections of FIG. 1 according to the line II—II, in which FIG. 2 shows the hair slide assembly in the disassembled state, FIG. 3 in half assembled state and FIG. 4 shows the hair slide assembly fully assembled, ready for use.

DETAILED DESCRIPTION OF THE INVENTION

In the embodiment shown the hair slide assembly 1 is, according to FIGS. 1 to 4, provided with a hair slide 2 acting as decorative part and a comb 3 acting as carrier.

Figure 1:
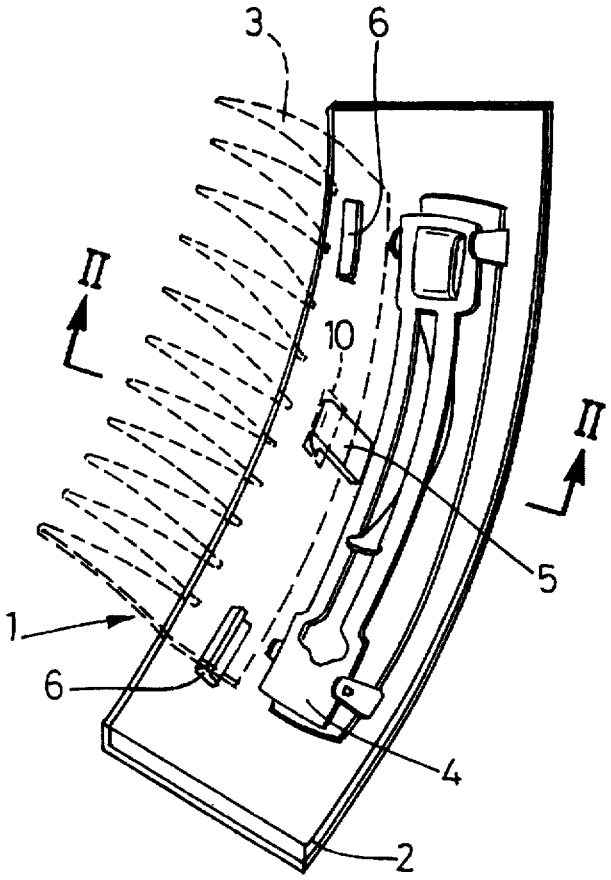
FIG. 1 is a perspective view of an embodiment of a hair slide assembly according to the invention, in which, for the sake of clarity, the comb is indicated by a dash line.

FIG. 1 shows that one side of the hair slide 2 is provided with a usual clasp 4 in the form of a so-called hair clip for holding the hair. This side of the hair slide 2 is also provided with (in this case permanent) fastening means for holding the comb 3. The other, not visible side of the hair slide, is provided with a decorated part. These fastening means can, however, also be supplied in the form of a separate element provided with the groove, which element is then detachably fastened to the reverse side of the decorated part of the hair slide. This is not shown in the Figures.

According to FIGS. 1 to 4 the fastening means comprise a snap fastening element 5 and one pair of hooks 6. The snap fastening element 5 is mounted more or less in the middle of the length of the hair slide 2 at a distance from and about parallel with the clasp 4 of the hair slide 2. The snap fastening element 5 extends more or less perpendicular to the hair slide 2, the snap part 7 of the snap fastening element 5 extending about parallel to the hair slide 2. The hooks 6 are mounted at a distance across from and at either side of the snap fastening element 5. The two legs of each hook 6 form an angle of about 90° or slightly more.

The comb 3 is provided with a number of teeth 8 and a rim 9 opposite the teeth 8. In the direction of the teeth 8 and in the direction perpendicular to them the comb 3 is somewhat curved. Thus the comb 3 has a convex upper side and a concave lower side. A recess 10 is provided between the teeth 8 and the rim 9 at the convex upper side of the comb 3. Also, on the concave lower side, at the hight of the rim 9, a projection 11 is provided at both ends of the comb 3.

Figure 2:
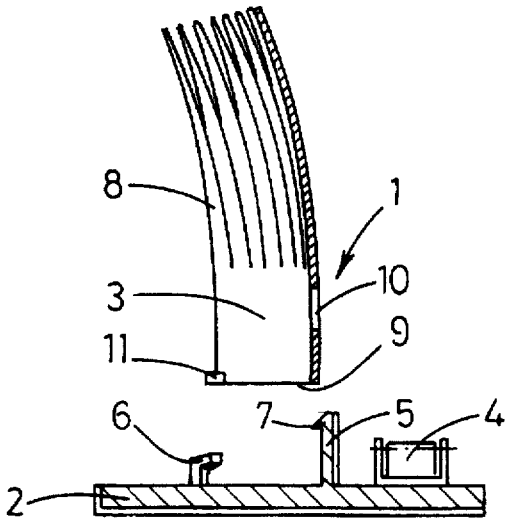
Figure 3:
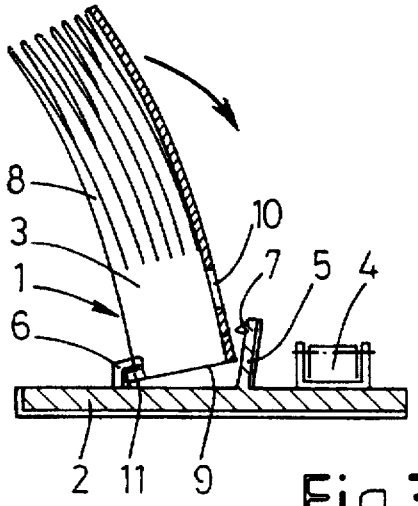
Figure 4:
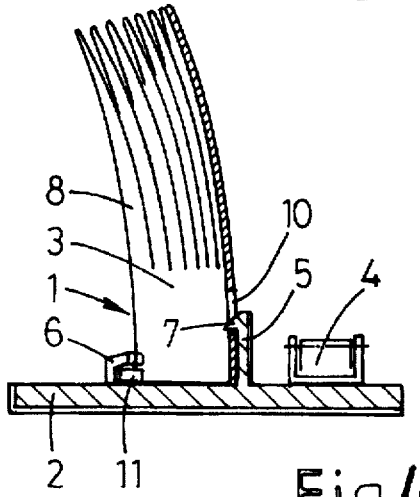

FIGS. 2 to 4 show the successive steps of fastening the comb 3 to the hair slide 2. When fastening the comb 3 to the hair slide 2, the comb 3 is placed with the rim 9 above the clasp side of the hair slide 2. As shown in FIG. 3, the comb 3 is initially slightly tilted, to allow the projections 11 to engage with an exact fit under the hooks 6. Subsequently the comb is tilted in the direction of the arrow in FIG. 3 and the rim 9 of the comb's convex upper side comes into contact with the snap fastening element 5. The snap part 7 of the snap fastening element 5 thus engages the recess 10 at the comb's 3 convex upper side. The hooks 6 are clearly directed slightly outward in order to allow them to follow the radius of the comb. Likewise, the distance in cross direction between the snap fastening element 5 and the hooks 6 of the hair slide 2 corresponds with the distance between the recess 10 and the projections 11 of the comb 3, which is determined by the radius of the comb 3.

It will be clear from the foregoing, that the invention provides a hair slide assembly which is easy to fix in the hair, styles the hair and keeps it styled and which also looks very decorative. The hair slide assembly according to the invention can be assembled according to the users own wishes and fixed in the hair.

In order to limit the cost price the hair slide may be brought on the market as separate parts, for instance, in a package containing a separate comb, a separate decorative part and a fastening means to fasten the comb and the decorative part to each other.

The invention is not limited to the embodiments given in the drawing and in the above description; different variations are possible within the scope of the invention. The comb and the slide of the hair slide assembly according to the invention may, for instance, be connected to each other by a hinge, so that the angle between the hair slide and the comb can be varied.

I claim:

1. A hair slide assembly for holding together and decorating hair, the assembly comprising a carrier having a plurality of teeth, a decorative part attached to the carrier and having a decorative side exposed to view during use and a reverse side, and a clasp attached to the decorative part, wherein the carrier and the decorative part are positioned at an angle with respect to each other during use and the carrier is disposed completely on the reverse side of the decorative part with the teeth of the carrier extending away from the decorative part.

2. A hair slide assembly according to claim 1, wherein the decorative part is substantially perpendicular to the carrier.

3. A hair slide assembly according to claim 1, wherein the decorative part and the carrier are detachably fastened to each other.

4. A hair slide assembly according to claim 1, wherein fastening means are attached to the decorative part proximate to a side of the clasp.

5. A hair slide assembly according to claim 1, wherein the decorative part is a hair slide.

6. A hair slide assembly according to claim 4, wherein the carrier is a comb having a rim from which the teeth extend.

7. A hair slide assembly according to claim 6, wherein the fastening means comprises a groove formed on the reverse side of the decorative part of the hair slide to receive at least part of the rim of the comb facing away from the teeth.

8. A hair slide assembly according to claim 7, wherein the fastening means comprise an element with a groove, which element is detachably fastened to the reverse side of the decorative part of the hair slide.

9. A hair slide assembly according to claim 6, wherein the fastening means comprises an assembly including at least a snap fastening element for the reception of a recess formed at one side of the comb and at least two hooks for the reception of projections formed at an opposite side of the comb.

* * * * *